United States Patent [19]

Wilson et al.

[11] Patent Number: 4,789,265

[45] Date of Patent: Dec. 6, 1988

[54] COURT RESURFACING APPARATUS AND PROCESS

[75] Inventors: Jack H. Wilson, Jackson; Willis G. Dykes, Vicksburg, both of Miss.

[73] Assignee: Sport Koter U.S.A., Inc., Jackson, Miss.

[21] Appl. No.: 10,936

[22] Filed: Feb. 5, 1987

[51] Int. Cl.[4] ..... E01C 19/16

[52] U.S. Cl. ..... 404/75; 404/96; 404/101; 427/136; 118/108

[58] Field of Search ..... 404/72, 75, 96, 101, 404/111; 118/108, 207; 427/138, 136; 273/29 R

[56] References Cited

U.S. PATENT DOCUMENTS

| | | | |
|---|---|---|---|
| 1,760,442 | 5/1930 | Robb | 404/83 |
| 1,914,950 | 6/1933 | Kanen | 404/111 |
| 2,175,511 | 10/1939 | Wahlstrom et al. | 404/111 |
| 2,182,217 | 12/1939 | Wahlstrom et al. | 404/101 |
| 2,342,762 | 2/1944 | Smith | 118/207 |
| 3,153,992 | 10/1964 | Dabelle | 404/111 |
| 3,174,413 | 3/1965 | Wittmack, Jr. | 404/118 |
| 3,220,321 | 11/1965 | Lewis | 404/96 |
| 3,272,098 | 9/1966 | Buchholtz et al. | 427/136 X |
| 3,283,675 | 11/1966 | Gifford et al. | 404/111 |
| 3,703,856 | 11/1972 | Wikel et al. | 404/111 |
| 3,982,758 | 9/1976 | Howes, Jr. | 273/29 R |
| 3,989,403 | 11/1976 | Verive | 404/111 |
| 4,532,882 | 8/1985 | Ciraud | 118/108 |
| 4,621,944 | 11/1986 | Jordense | 404/96 X |

*Primary Examiner*—Jerome Massie
*Assistant Examiner*—Matthew Smith
*Attorney, Agent, or Firm*—Nixon & Vanderhye

[57] ABSTRACT

Method and apparatus are provided for resurfacing one or more adjacent tennis court surfaces. An elongated, box-like frame structure, supported for rolling movement on a plurality of casters, is provided with flexible blade and brush elements for engaging, spreading, and smoothing court resurfacing material at a predetermined thickness as the structure traverses the court surface. In accordance with method aspects of the invention, the device is movable in one direction to resurface an entire tennis court, and after lateral movement to an adjacent second court area, reversible to move in the opposite direction to resurface an entire second court surface. For a given resurfacing direction, the flexible blade elements engage the resurfacing material ahead of the device while the flexible brush elements engage the resurfacing material behind the device to effect final smoothing.

26 Claims, 5 Drawing Sheets

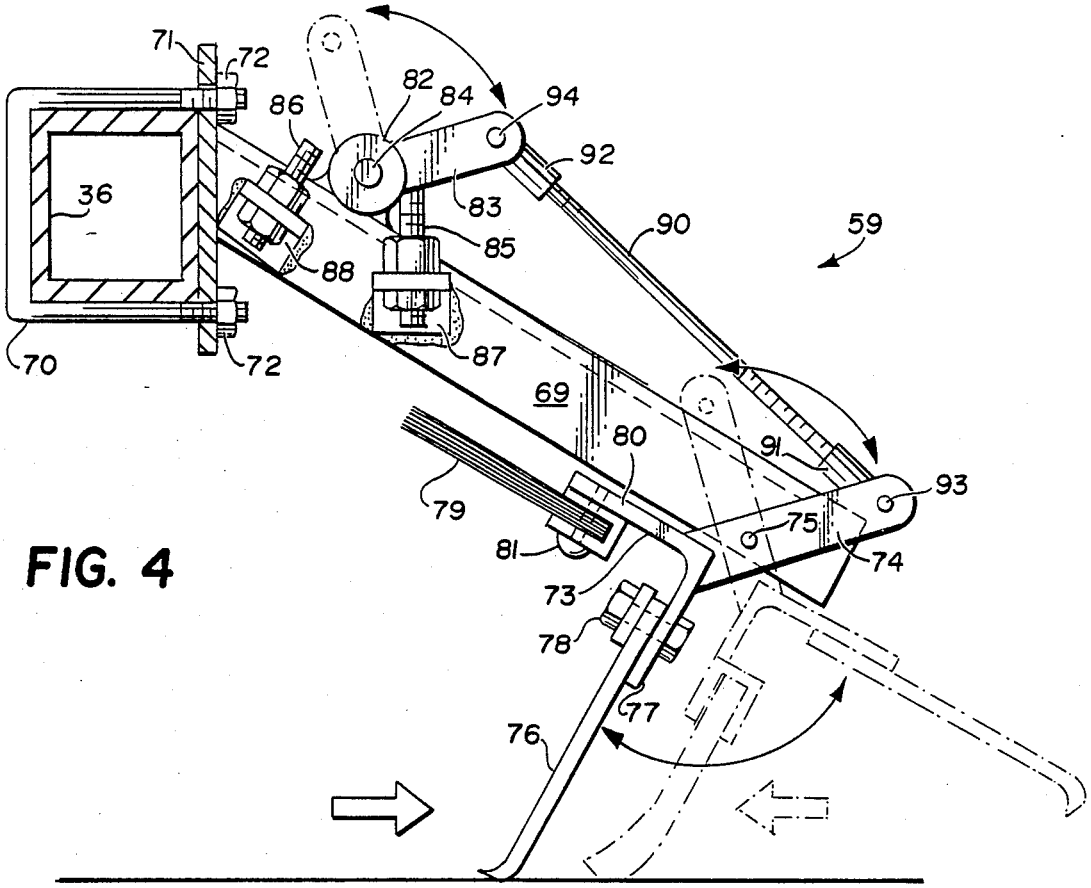
FIG. 4
FIG. 6
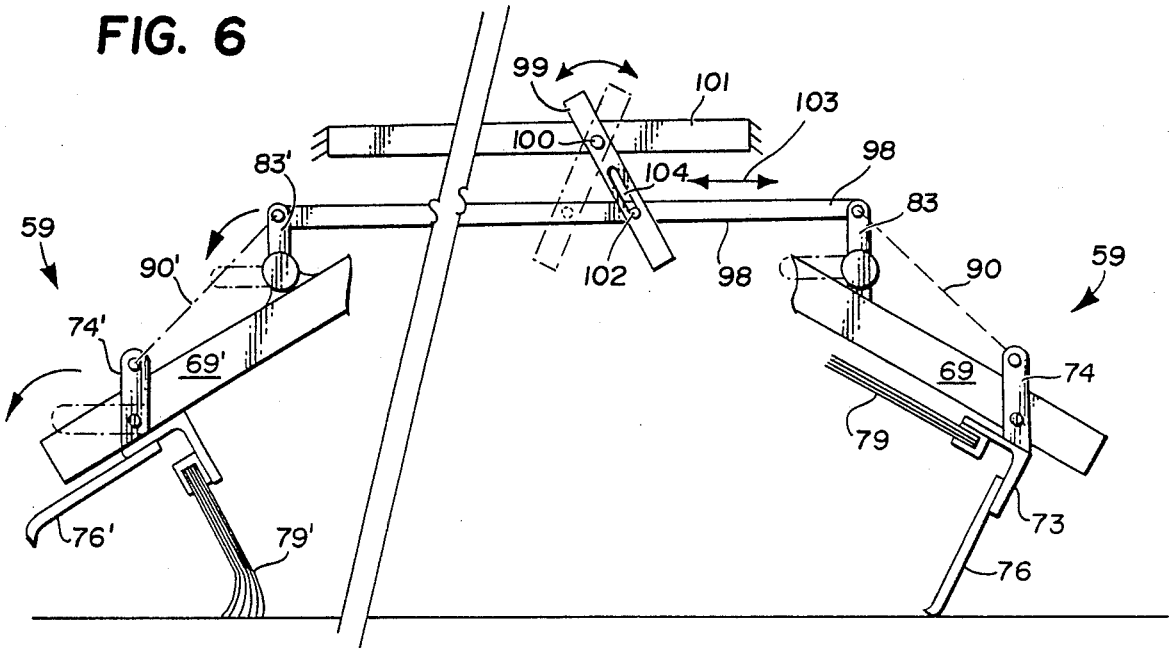

COURT RESURFACING APPARATUS AND PROCESS

BACKGROUND OF THE PRESENT INVENTION

This invention relates to the repair and maintenance of indoor or outdoor recreational surfaces and, particularly, to the resurfacing of tennis courts.

In the past, acrylic resurfacing material typically employed for tennis courts, has been applied manually and thereafter spread about by a number of individuals working with hand-held, squeegee-like spreaders. The resulting surface coating often varies in thickness and exhibits unsightly streaks resulting from the uneven application and multi-directional spreading techniques common in the prior art. The surface coating can range from thin to thick and, as a result, often shows noticeable deterioration even within one year after resurfacing.

The prior art method is also labor intensive, time consuming and therefore very costly. More importantly, a quality-result is not assured.

According to the present invention, apparatus and a process for resurfacing recreational surfaces, particularly tennis courts, are presented herein which have several advantages over the prior art.

The present invention relates to a mobile, self-propelled device which can uniformly spread and smooth resurfacing material at a predetermined thickness. In addition, the self-propelled device of this invention can resurface a regulation size tennis court in a fraction of the time required by conventional techniques.

According to one exemplary embodiment of the invention, an elongated box-shaped frame, preferably constructed in three separable sections, is supported on a plurality of directionally adjustable wheels, or casters, for movement in any one of a plurality of selectively chosen directions. The total length of the three-section frame may be varied as desired but preferably exceeds the width of a regulation size tennis court.

A variable speed, reversible drive motor, preferably a gasoline or diesel internal combustion engine, provides power input to a pair of drive wheels which can be moved by way of a manually operated handle from an inoperable position wherein the wheels are held above ground, to an operable position where the wheels are in contact with the ground so as to move the machine in the selected direction.

It will be appreciated that since the machine is designed to operate in either of two opposite directions, and since the structure on both longitudinal sides of the machine is essentially identical, the terms front and rear, and forward and reverse, have no particular meaning absent some point of reference. For ease of discussion herein, the "front" of the machine merely refers to that side facing in the direction of movement, and the "rear" of the machine refers to that side which faces away from the direction of movement. Mounted to lower horizontal beam members of the box-like frame, along both front and rear sides of the apparatus, are flexible rubber spreading and smoothing blades, as well as flexible bristle brush means. Adjustable mounting brackets along both longitudinal sides of the machine enable the machine operator to rotate either the blade or brush means into operable position on either side of the machine depending on the direction of machine movement, as explained further hereinbelow.

In a preferred arrangement, when the machine is moving in one direction, the flexible blade means in the front of the machine and the brush means in the rear of the machine will be in operable positions. When the machine moves in the opposite direction, the operator manually reverses the blade/brush assemblies. In other words, the flexible blade means are always leading and the brush means are always trailing during any resurfacing operation. In one exemplary embodiment of the invention the blade/brush assemblies on both sides of the machine are interconnected for simultaneous movement between inoperative and operative positions.

This arrangement is particularly advantageous insofar as the flexible blade means serve to spread and smooth out the resurfacing material at a uniform predetermined thickness while the trailing brush means serve to further smooth out the resurfacing material and, particularly, to eliminate any tracks or other surface disturbances caused by either the casters or drive wheels or both.

It will be understood that the flexible blade means and brush means are angularly adjustable with respect to the ground. Moreover, the flexible blade means, preferably made of rubber, may be selected on the basis of hardness (Durometer value), so that, by careful coordination of mounting angle and blade hardness, the thickness of the coating of material may be predetermined and held uniform throughout the resurfacing operation.

It is further contemplated by this invention that the machine be capable of slight steering corrections, on the order of a degree or more, so as to insure proper alignment of the machine with respect to the boundaries of the tennis court. This is accomplished by permitting a slight angular shifting of the drive means of the machine.

The process aspects of the invention involve (1) positioning of the resurfacing machine at a first end, but outside the boundaries, of a tennis court, and preferably parallel to one of the end lines; (2) applying resurfacing material in front of the machine, preferably along its entire length in a series of spaced lengthwise masses, or windrows; and (3) moving the machine forwardly along at least the entire length of the tennis court and beyond the other end line, spreading out and smoothing the resurfacing material by the leading blade means, and smoothing out the caster and drive wheel tracks by the trailing brush means.

In the event that an adjacent, second court is to be resurfaced, the drive wheels are disengaged and the caster directions adjusted to enable the machine to be moved laterally to a position at the second end of the second court. The casters are then readjusted and the blade and brush means reversed. After additional resurfacing material is applied as described above, the machine is then driven along the length of the second court in a direction opposite that traveled during resurfacing of the first court.

It will be understood that during movement of the machine, resurfacing material is added as needed in front of, and along the length of the machine, generally parallel to the flexible blade means.

When the operation is completed, the various sections may be disassembled and transported to the next job site.

Further objects and advantages of the invention will become apparent from the detailed discussion which follows.

BRIEF DESCRIPTION OF THE DRAWINGS

FIG. 4 is a side view, partially in section, illustrating in greater detail a blade and brush assembly for a resurfacing machine in accordance with an exemplary embodiment of this invention;

FIG. 6 is a partially schematic side view of a interconnected front and back blade and brush assemblies for use with a resurfacing machine in accordance with another exemplary embodiment of the invention;

DETAILED DESCRIPTION OF THE INVENTION

Figure 1:
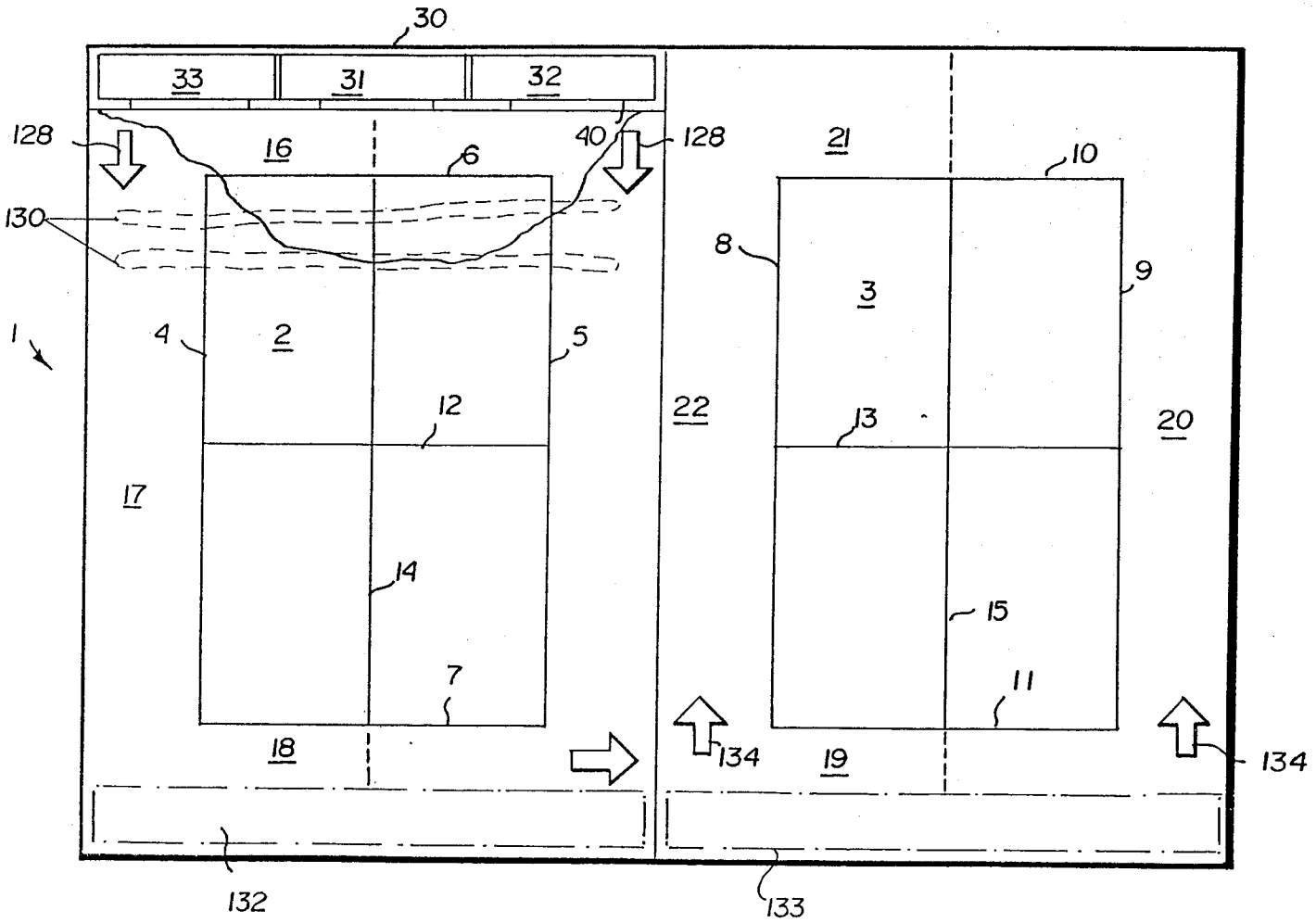
FIG. 1 is a schematic view of a resurfacing machine in accordance with this invention, positioned for a resurfacing operation on a pair of adjacent tennis courts.

Referring now to FIG. 1, a typical multiple court configuration 1 includes a pair of side-by-side tennis courts 2, 3. Court 2 is defined by lengthwise boundary lines 4, 5 and widthwise boundary lines 6, 7. Similarly, court 3 is defined by lengthwise boundary lines 8, 9 and widthwise boundary lines 10, 11.

Typically, tennis courts are divided in half by lines 12, 13 which coincide with the location of nets (not shown). Court 2 is divided longitudinally by line 14 to define service areas while court 3 is similarly divided by line 15. In the context of this invention, lines 4, 5, 8 and 9 are considered the outer boundary lines typically employed in doubles matches. In other words, for purposes of this invention, it is the outermost court boundaries that are significant, and other, interior lines, such as singles match boundaries and service lines are not shown.

It will be appreciated that surrounding surfaces such as those indicated by reference numerals 16, 17, 18, 19, 20, 21, as well as the surface 22 between the two courts, typically have the same composition as the courts themselves, and are therefore subject to the same maintenance and repair requirements. Thus, any resurfacing operation would normally include all surfaces in surrounding relationship to the courts proper.

FIG. 1 also illustrates, generally, a resurfacing machine 30 positioned in surface area 16 outside the boundaries of court 2, and in generally parallel alignment with the widthwise boundary line 6.

Figure 2:
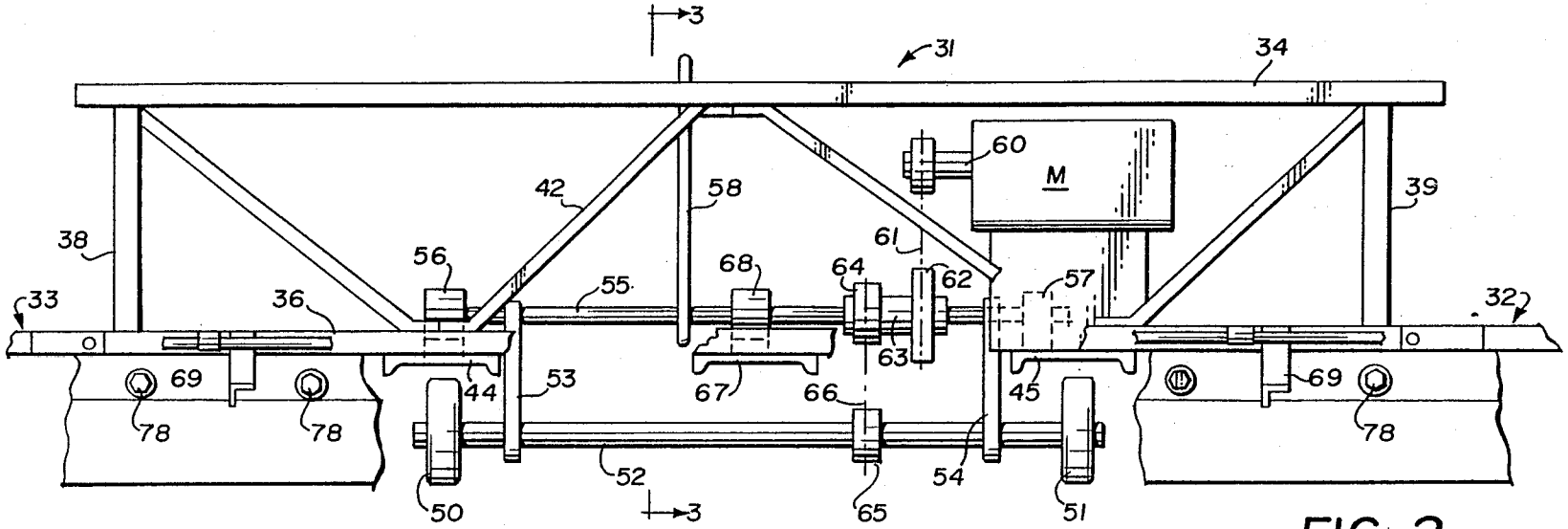
FIG. 2 is a partial front view of a center section of a resurfacing machine in accordance with an exemplary embodiment of the invention, partially cut away, and with other parts removed, in order to clearly illustrate a drive configuration for the machine.
Figure 3:
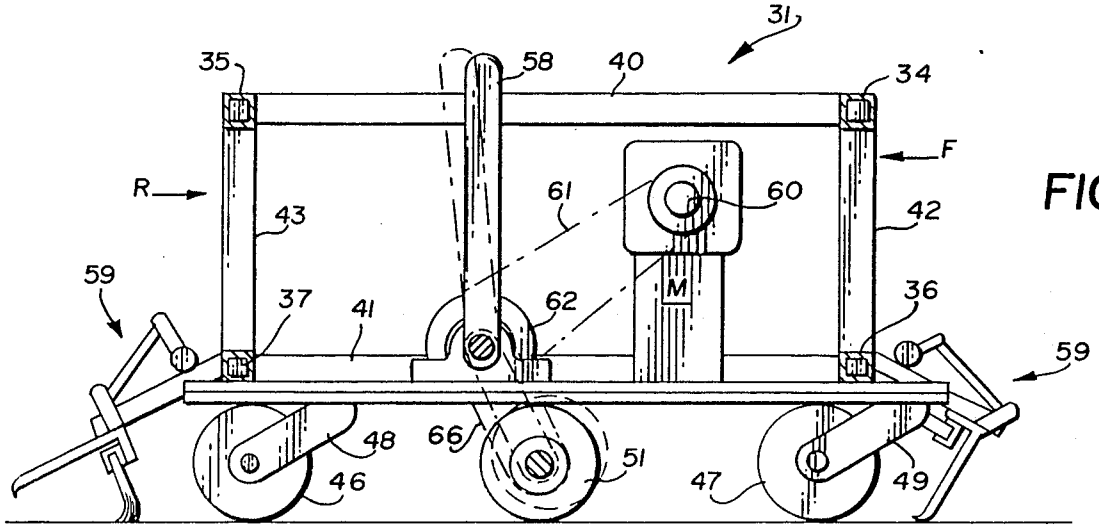
FIG. 3 is a side sectional view taken along the line 3—3 of FIG. 2, but with supporting casters added.

The machine 30 consists of a generally rectangular box-like framework constructed in three separable sections 31, 32 and 33. Since the framework of each section is similar, only the center section 31 will be described in detail. Referring now to FIGS. 2 and 3, the center section of the framework includes upper horizontal front and rear beams 34, 35 and lower, horizontal front and rear beams 36, 37. In this regard, for the sake of discussion and ease of understanding, the right side of the machine in FIG. 3 shall be referred to as the front F and the left side as the rear R of the machine. At the section ends, vertical connecting beams 38, 39 extend between beams 34, 36 at the front of the machine. Similar vertical connecting beams (not shown) extend between beams 35, 37 at the rear of the machine. At one side of the center section, upper and lower front-to-back connecting beams 40 and 41 extend between upper beams 34, 35 and lower beams 36, 37, respectively. Diagonal trusswork 42 extends along the front face of the machine between vertical beams 38, 39 and interconnecting upper horizontal beam 34 and lower horizontal beam 36. Similar trusswork 43 extends along the rear face of the machine interconnecting upper horizontal beam 35 and lower horizontal beam 37.

A pair of supporting or cross beams 44, 45 extend between lower front and rear horizontal beams 36, 37 and are provided for reasons discussed in greater detail hereinbelow.

Side sections 32 and 33 are bolted or otherwise suitably fastened to the center section 31, as partially shown in FIG. 2.

As best seen in FIG. 3, the center section 31 is supported on four casters, two of which 46, 47 are shown mounted to cross beam 45 via caster brackets 48, 49, respectively. A second pair of casters (not shown) are identically mounted on the cross beam 44. It will be appreciated that side sections 32, 33 are similarly supported by four casters each. The caster assemblies have been removed from FIG. 2 in order to more clearly illustrate the drive means described below.

A pair of drive wheels 50, 51 are keyed to a drive axle 52 for rotation therewith. Axle 52 has a pair of connecting arms 53, 54 which mount the axle for rotation about a parallel shaft 55 rotatably journaled in a pair of bearings 56, 57 mounted on cross beams 44, 45. A handle 58 is fixed to shaft 55 for selectively moving drive wheels 50, 51 via connecting arms 53, 54 from a ground engaging, or operable position, shown in solid lines in FIG. 3, to an inoperative position, shown in phantom, where the drive wheels are raised an inch or so above the ground.

In order to drive the wheels 50, 51, a standard variable speed, reversible motor M is employed. The motor, which may be a gasoline or diesel internal combustion engine, is fixedly secured to cross-beam 45 and includes an output shaft 60 connected by chain or other suitable drive belt means 61 to a gear 62. Gear 62 is secured to a sleeve bearing 63 supported on shaft 55 for rotation relative thereto. A second gear 64 is secured to the sleeve bearing 63 for driving connection with shaft 52. To this end, a gear 65 is mounted on shaft 52 and is connected to gear 64 by chain 66 or other suitable drive belt means.

It will thus be understood that shaft 52 and drive wheels 50, 51 are driven by motor M through a drive train consisting of gears 62, 64, and 65 and a pair of drive chains 61 and 66. It will be further understood that the drive train remains unaffected by the movement of drive wheels 50, 51 from an inoperative to an operative position, particularly by reason of the rotatable sleeve bearing unit 63 which is able to rotate relative to shaft 55.

In FIG. 2, a third cross-beam 67 is shown extending between beams 36, 37 intermediate cross-beams 44 and 45. Aside from adding rigidity to the structure, this third cross-beam supports an intermediate bearing 68 through which shaft 55 rotatably passes.

Figure 5:
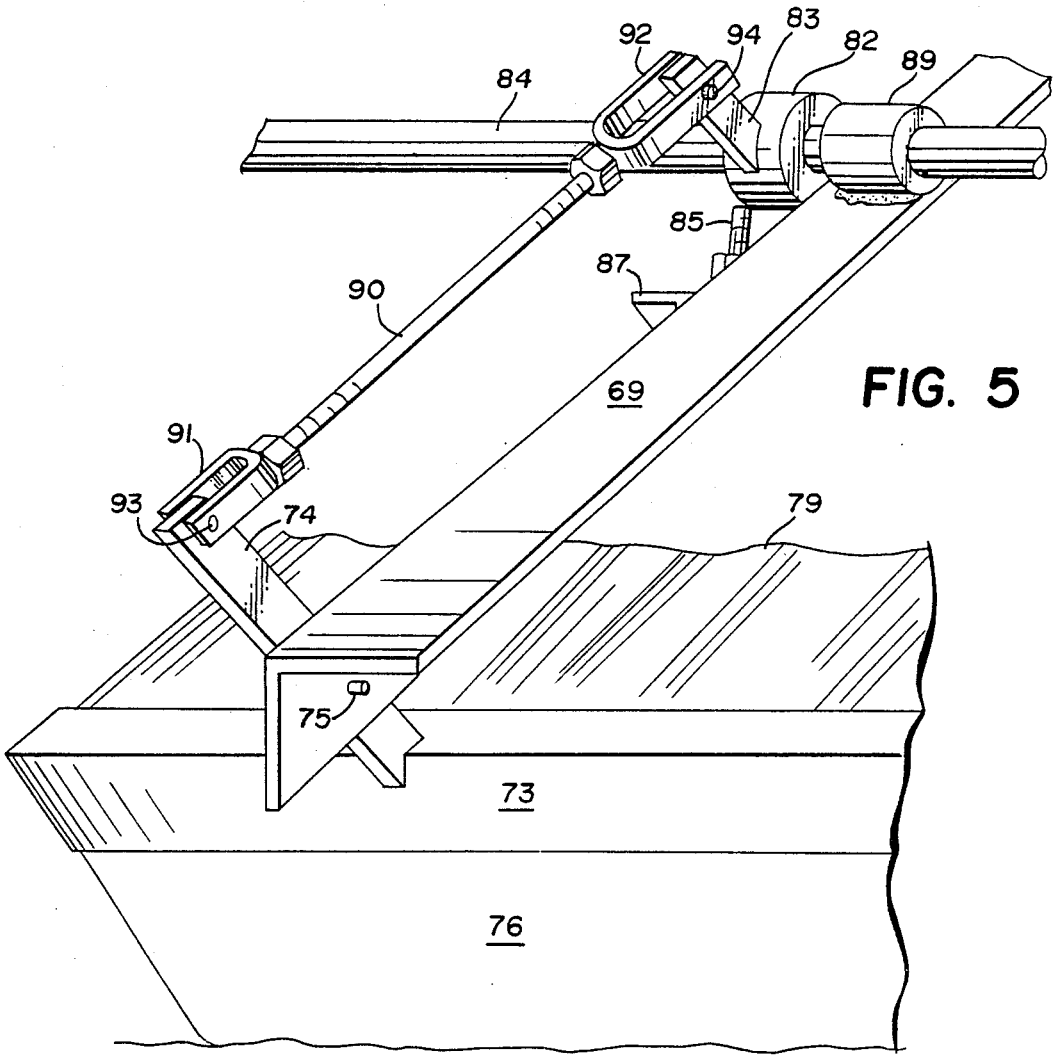
FIG. 5 is a partial perspective view of the blade and brush assembly illustrated in FIG. 4.

FIGS. 4 and 5 illustrate in detail the mounting arrangement for a flexible blade and brush means assembly 59 which serve to spread and smooth the resurfacing material. As can be appreciated from FIG. 3, identical blade/brush assemblies are mounted so as to extend along both front and rear faces of the machine, coextensive with its length.

Because the assemblies 59 associated with the front and rear faces of the machine are substantially identical, only one mounting configuration need be described in detail.

As shown in FIG. 4, the lower horizontal beam 36, which extends the length of center section 31, mounts at least one, and preferably at least a pair of angle brackets 69 via C-shaped bracket studs 70 having threaded free end portions, end plate 71, and nuts 72. In an exemplary embodiment, the bracket 69 is welded to plate 71 at a fixed angle of inclination such that bracket 69 extends downwardly and away from the machine. A second, generally horizontally oriented angle bracket 73 is mounted for rotation with respect to angle bracket 69 by a link arm 74 pivotally mounted to bracket 69 by a pin 75. It will be understood that angle bracket 73 extends longitudinally along at least the full length of center section 31, supported by at least a pair of spaced brackets 69 (see FIG. 2).

A flexible blade element 76, preferably of a rubber composition, is fixedly secured to one side 77 of bracket 73, as by a plurality of bolts 78 or other suitable fasteners, while a flexible bristle brush 79 is fixedly secured to the other side 80 of the bracket by a plurality of screws 81 (only one of which is shown) or other suitable fasteners.

At the opposite end of the angle bracket 69 and adjacent beam 36, a sleeve 82 and associated link arm 83 are received on a shaft 84 for rotation therewith.

The link arm 83 rotatable within limits set by adjustable screws or bolts 85, 86 threadably secured in L-shaped angles 87 and 88, respectively, which are welded or otherwise secured to one side surface of bracket 69. As best seen in FIG. 5, the shaft 84 is journaled in a sleeve bearing 89 welded or otherwise secured to another side surface of the bracket. Link arms 74 and 83 are operatively connected by a rod 90 threadably received in U-shaped coupling elements 91, 92 which are pivotally secured to the arms 74, 83 by pins 93, 94.

The above described arrangement permits the machine operator to choose which of the flexible blade means 76 and bristle brush means 79 will be in an operative position, depending on the direction of motion of the machine. As shown in FIGS. 4 and 5, the flexible blade 76 is in operable position to spread and smooth out the resurfacing material applied to the court surface ahead of the machine proper.

In the event the direction of machine movement is reversed (not shown), to resurface a second adjacent court, shaft 84 is rotated, by an attached handle, for example, to rotate link arm 74, via link arm 83 and threaded rod 90, and thereby move blade means 76 into an inoperative position (shown in phantom in FIG. 4) and brush means 79 into operative position.

It should be understood that for any of sections 31, 32 or 33, the flexible blade means and bristle brush means are co-extensive with the length of the particular section. Adjacent blade sections should be in closely abutting, side-by-side relationship to avoid surface irregularities at the interface thereof. Any such irregularities appearing at the interface of adjacent sections of the leading blades could easily be smoothed out, however, merely by slightly offsetting the interface of the trailing brushes.

In all cases, in order to assure accurate and uniform thickness of the resurface coating, it is important that the blade supporting angle bracket 73 be precisely positioned. To this end, it will be appreciated that such precise positioning is enabled through adjustment of limit bolts 85, 86 and adjustment of the effective length of the threaded rod 90. Since link arm 83 and rod 90 control the movement of link arm 74, they also define the position of angle bracket 73 in its operative position.

It will further be appreciated that the flexibility of the blade means 76 (as determined by its hardness, or Durometer value) also has a significant effect on the thickness of the applied coating, insofar as its flexibility determines in part the contact angle of the blade means with the resurfacing material. Thus, careful selection of an appropriate rubber composition for the blade means, and precise adjustment of the variously described supporting bracket elements, enables precise and uniform spreading of resurfacing material at a predetermined thickness.

Turning now to FIG. 6, an alternative embodiment is illustrated wherein front and rear blade and brush assemblies 59 are linked by a tie rod 98 connected at its ends to link arms 83, 83' which are, in turn, connected to link arms 74, 74' via adjustable rods 90, 90'.

A control rod 99, pivotally mounted at 100 to a fixed frame member 101, engages a pin 102 provided on tie rod 98 to move the tie rod back and forth in directions generally indicated by arrow 103. Because movement of tie rod 98 follows a slightly arcuate path, due to pivoting movement of arms 83, 83', a slot 104 is provided in control rod 99 to accommodate such movement.

As viewed in FIG. 6, the blade and brush assemblies are positioned for left to right machine movement, i.e., with a leading blade means 76 and a trailing brush means 79'. For machine movement in the opposite direction, the blade/brush assemblies are reversed by actuation of control rod 99. Thus, clockwise movement of rod 99 will simultaneously move blade means 76' and brush means 79 from inoperative to operative positions, and brush means 79' and blade means 76 from operative to inoperative positions. This arrangement greatly facilitates resurfacing operations of multiple court surfaces in side-by-side relationship, since the machine is not limited to movement in a single direction during resurfacing.

Figure 7:
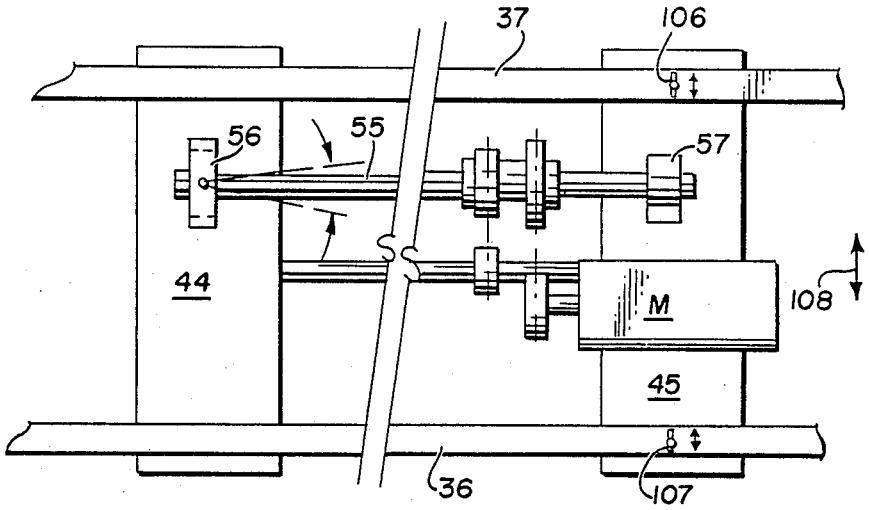
FIG. 7 is a partial plan view of a drive arrangement for a resurfacing machine in accordance with the invention.

FIG. 7 is a partial top view of the center section 31 of the machine illustrating an arrangement which permits a slight degree of steerability of the machine. Cross beam 45 which supports the motor M as well as the shaft bearing means 57, is movable transversely with respect to the lower horizontal beams 36, 37 by reason of slots 106, 107 formed in beams 36 and 37. At the same time, shaft 55 is permitted a slight pivoting action in the bearing 56 mounted on cross beam 44. The pivoting action of shaft 55 is necessary to maintain proper alignment of the various components of the drive means upon shifting of the cross beam 45. It is to be understood that the degree of movement of cross beam 45 is slight, such that shaft 55 may pivot perhaps only one degree or so in either direction from its normal position. By this arrangement, the machine operator, may slightly alter the path of travel of the machine if he visually determines that the machine is slightly askew with respect to, for example, the center line of the court being resurfaced.

Figure 8:
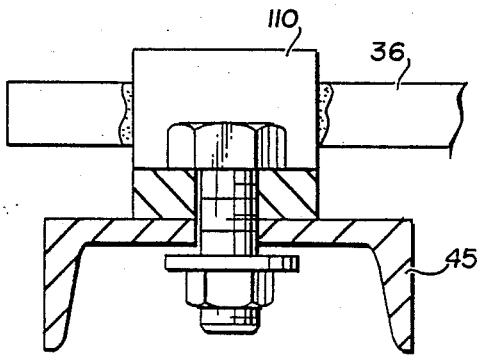
FIGS. 8 and 9 are sectional views of alternative coupling configurations of a cross-beam and longitudinal frame beam in a resurfacing machine in accordance with the invention.
Figure 9:
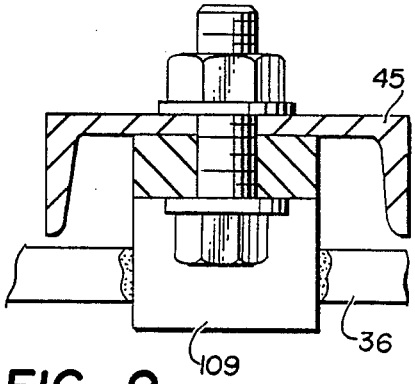

FIGS. 8 and 9 illustrate alternative coupling arrangements, utilizing L-brackets 109, 110 to secure the cross beam 45 to the lower horizontal beam members, and which permit shifting of the cross beam.

Figure 10:
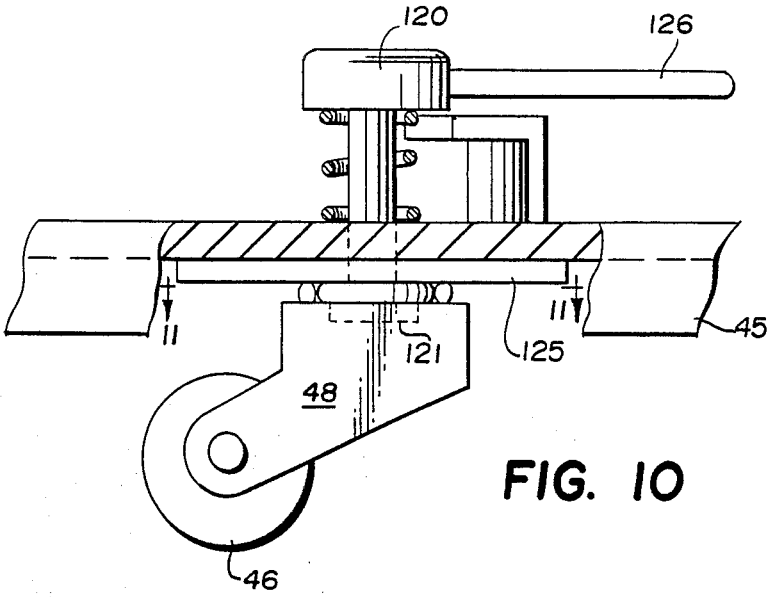
FIG. 10 is a side view, partially in section, illustrating a supporting caster for a resurfacing machine, the caster shown in a releasably locked directional orientation.
Figure 12:
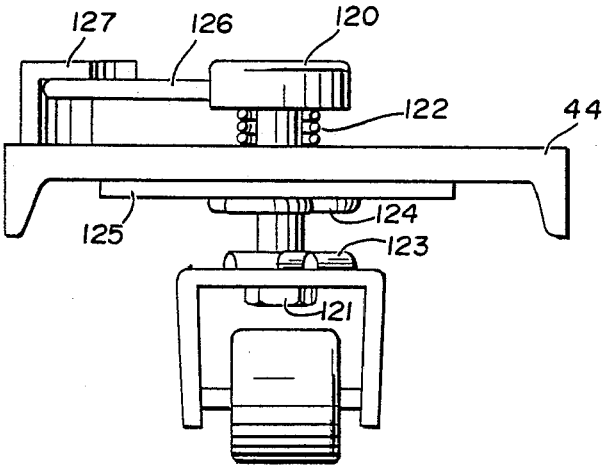
FIG. 12 is a front view of a supporting caster for a resurfacing machine, the caster shown in a releasably locked, freely rotatable position.
Figure 11:
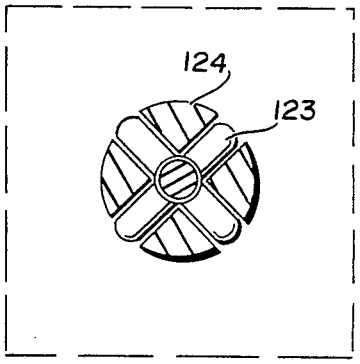
FIG. 11 is a partial plan view taken along the line 11—11 of FIG. 10.

FIGS. 10, 11 and 12 disclose a caster of mounting arrangement which permits the various supporting casters to be releasably locked for movement in any one of four directions, or in a position where the caster is free to swivel in any direction. In FIG. 10, a caster 46 is shown mounted to a cross beam 45 by a bolt 120 and nut 121. The caster bracket 48 is provided on its top surface with four raised projections 123 arranged 90 degrees with respect to one another in an X-shaped configuration, as best seen in FIG. 11. These projections cooperate with a series of indentations formed by pie-shaped projections 124 formed in a mounting plate 125 which is welded or otherwise securely fixed to the cross beam 45. A coil spring 122 or other suitable resilient biasing means, is placed between the bolt head and the cross beam 45 to bias the bolt 120 and the caster upwardly to a position where projections 123 are received within the indentations formed between projections 124 on the plate 125. It will be appreciated that by pressing downwardly on the bolt head 120, projections 123 disengage from the indentations between projections 124, permitting rotation of the caster and caster bracket 48 to any one of the four illustrated detent positions arranged at 90 degree intervals.

It will be noted that the lateral projection or handle 126, integrally formed with or attached to the bolt head 120, facilitates turning of the caster, but also serves to lock the caster in a depressed position where projections 123 are disengaged from the plate 125 so as to allow free rotation of the caster. As clearly shown in FIGS. 10 and 12, an L-shaped angle member 127 is provided on the cross beam 44 at a position where it may receive handle 126 in a downwardly compressed position. By simply pressing even further downwardly on bolt head 120 and/or handle 126, the bolt may be rotated out of engagement with the angle member 127 so that the caster may again be releasably locked in one of the detent positions.

This capability to releasably lock the casters enables the machine to be accurately moved both longitudinally and laterally with respect to a court surface without the "drifting" motion usually associated with freely rotatable casters.

Referring back now to FIG. 1, the operation of the machine will be described in connection with a resurfacing operation for two adjacent tennis courts. Initially, the machine is placed beyond the boundary 6 of the court for movement lengthwise of the court as indicated by arrows 128. Prior to machine actuation, a number of windrows 130 of resurfacing material are applied ahead of the machine in a manner as generally indicated in FIG. 1. It will be understood, of course, that additional windrows are applied between the machine itself and, for example, the boundary line 6 of the court. After application of the resurfacing material, the machine drive is actuated to cause the machine to traverse the entire length of court until it reaches a position indicated in phantom by the reference numeral 132. During this path of travel, it will be understood that leading flexible blade means spread and smooth out the windrows 130 of resurfacing material to form a uniform coating of predetermined thickness over the entire surface of the court. At the same time, flexible brush means trailing the machine smooth out and eliminate any tracks or other surface irregularities caused by movement of the casters and drive wheels through the resurfacing material.

Once the machine has reached the position indicated by reference numeral 132, the casters on sections 31, 32 and 33 are releasably locked for movement in a lateral direction and the drive wheels are retracted to their inoperative position so that the machine may be pushed laterally to a position indicated by reference numeral 133 at the end of a second court 3. Upon readjustment of the casters, and upon reversal of the flexible blade and brush assemblies as previously described, the machine is ready to traverse a path indicated by arrows 134. Prior to actuation, additional windrows 130 of resurfacing material would, of course, be applied to the surface of court 3.

During lateral movement of the machine from position 132 to 133, it will be advantageous to have additional flexible brush means depending from widthwise frame members of the device to smooth out any tracks caused by the casters as the machine is moved laterally from court 2 to court 3.

While the invention has been described in what is presently perceived to be its most practical embodiments, those of ordinary skill in the art will understand that various changes and modifications may be made without departing from the spirit and scope of the claims which define the invention as follows.

What is claimed is:

1. A method of resurfacing a substantially rectangular tennis court surface having outer boundaries including a pair of end lines defining substantially identical width dimensions for the court surface and a pair of side lines defining substantially identical length dimensions for the court surface, the method comprising the steps of:

(a) providing a resurfacing device including frame means having a forward face and a rearward face, wherein said frame has a length dimension at least equal to the width dimension of said court surface, and wherein said device is provided with resurfacing material spreading and smoothing means mounted on said frame and coextensive with the length of said frame;

(b) aligning said device outside the outer boundaries of the tennis court surface and substantially parallel to one line of said pair of end lines and side lines such that the forward face of the frame means faces the said one line;

(c) applying a mass of resurfacing material at least between the forward face of the frame means and the said one line;

(d) moving the device across the tennis court surface in a forward direction substantially transverse to said one line such that said spreading and smoothing means spreads and smooths said resurfacing material across all of said tennis court surface in a single pass.

2. A method as defined in claim 1, wherein said resurfacing material is an acrylic composition.

3. A method as defined in claim 1, and wherein step (d) includes applying additional resurfacing material as said device is moved across said court.

4. A method as defined in claim 1, wherein said resurfacing material spreading and smoothing means comprises a leading flexible blade means mounted on the forward face of the frame means, and a trailing brush means mounted on the rearward face of the frame means.

5. A method of resurfacing a plurality of side-by-side substantially rectangular court surfaces, each of which has length and width dimensions defined by outer boundary lines, the method comprising:

(a) providing a resurfacing device including frame means having a forward face, a rearward face, and drive means mounted on said frame means between said forward and rearward faces; wherein said frame means has a length dimension at least equal to the width dimension of one of said court surfaces, and wherein said device is provided with resurfacing material spreading and smoothing means mounted on the forward and rearward faces of the frame means, coextensive with the length of said frame means;

(b) aligning said device outside the outer boundary lines of a first of said plurality of court surfaces and substantially parallel to one of said outer boundary lines such that said forward face of the frame means faces the said one of the outer boundary lines;

(c) applying a mass of resurfacing material at least between the forward face of the frame means and the said one of the outer boundary lines; and (d) actuating said drive means to move said device in a first path across the first of said court surfaces in a forward direction substantially transverse to said one of said outer boundary lines such that said spreading and smoothing means spreads and smooths said resurfacing material substantially uniformly across all of said first of said court surfaces in a single pass;

(e) moving said device in a second path transverse to said first path to a position outside and substantially parallel to an outer boundary line of a second of said plurality of court surfaces, such that the rearward face of said frame means faces the said outer boundary line of second of said plurality of court surfaces;

(f) applying a mass of resurfacing material at least between the rearward face of the frame means and the said outer boundary line of said second of said plurality of court surfaces;

(g) actuating said drive means to move said device across the second of said plurality of court surfaces in a third path opposite in direction but substantially parallel to said first path such that said spreading and smoothing means spreads and smooths said resurfacing material substantially uniformly across all of said second of said plurality of court surfaces in a single pass.

6. The method as recited in claim 5 wherein said spreading and smoothing means comprise an elongated, flexible blade means and an elongated, flexible brush means mounted on, and extending along, each of said forward rearward faces of said frame means.

7. A method as defined in claim 5 and including the further step of controlling the thickness of the resurfacing material during steps (d) and (g).

8. A method as defined in claim 5, wherein said court surfaces are regulation tennis court surfaces and wherein said resurfacing device has a length greater than the width dimension of a regulation tennis court such that, upon completion of steps (g), all of said first and second tennis court surfaces, and surfaces surrounding and between said first and second tennis court surfaces are uniformly resurfaced.

9. A method of resurfacing a regulation tennis court having prescribed length and width dimensions comprising the steps of:

(a) applying a mass of resurfacing material along and outside at least one outer boundary corresponding to the width dimension of said court; and (b) spreading and smoothing said material to a substantially uniform predetermined thickness with a resurfacing device having a length equal to at least the width dimension of said tennis court by moving the device across court in a single pass and in the direction of said length dimension.

10. A method of resurfacing a regulation tennis court as defined in claim 9, wherein step (a) is practiced by manually applying a plurality of spaced windows of acrylic material, the windrows being oriented generally perpendicular to said direction.

11. Apparatus for resurfacing a tennis court surface comprising:

frame means having a length at least equal to the width of a regulation tennis court;

a plurality of frame supporting wheels mounted on the underside of said frame means;

selectively engageable drive means mounted on said frame means for effecting movement of said frame means;

flexible blade means mounted on said frame means forward of said drive means, and extending substantially the length of said frame means; flexible brush means mounted on said frame means rearward of said drive means and extending substantially the length of said frame means; said flexible blade and brush means adapted to engage a mass of resurfacing material applied to said court surface and to spread and smooth said material as said frame means traverses said court surface.

12. Apparatus as defined in claim 11, wherein said flexible blade means are adjustable so as to provide a layer of resurfacing material of predetermined thickness.

13. Apparatus as defined in claim 11, wherein said flexible blade means are constructed of a rubber composition, and wherein adjustment means are provided for adjusting said blade means with respect to said surface, said rubber composition and said adjustment means together enabling accurate predetermination of the thickness of said resurfacing material.

14. Apparatus as defined in claim 11, wherein said frame means comprise three separable sections, each section having a length of approximately 20 feet, and wherein each of said sections is provided with supporting wheel means.

15. Apparatus as defined in claim 14, wherein said drive means is mounted on said center section and movable from a first operative position to a second inoperative position, wherein said drive means includes a pair of drive wheels operatively connected to a power source, and wherein said drive wheels are raised above the ground in said second inoperative position.

16. Apparatus as defined in claim 15, wherein said drive wheels have means associated therewith for achieving a degree of steerability for said apparatus.

17. Apparatus as defined in claim 15, wherein said power source comprises an internal combustion engine.

18. Apparatus as defined in claim 15, wherein said drive wheels are mounted on a drive and wherein means are provided for adjusting the angular relationship of said drive wheels and said drive axle relative to said frame means.

19. Apparatus as defined in claim 14, wherein said supporting wheel means are casters, and wherein means are provided for releasably locking said casters for movement in a selected direction.

20. Apparatus as defined in claim 11, wherein said drive means comprise wheels movable between a first inoperative position and a second operative position.

21. Apparatus for resurfacing a court surface comprising:

frame means having a length spanning at least the width of a regulation tennis court;

a plurality of wheel means mounted on the underside of said frame means;

selectively engageable drive means for effecting movement of said frame means;

flexible blade means mounted on, and extending substantially the length of said frame means, said flexible blade means adapted to engage a mass of resurfacing material applied to said court surface and to spread and smooth said material as said frame means traverses said court surface;

brush means extending across the length of said frame means, co-extensive with said blade means; wherein said blade means and brush means are mounted on a plurality of first bracket means located on one side of said device, said first bracket means including first actuating means for selectively alternatively moving either of said flexible blade means or said brush means from a first inoperative position to a second operative position.

22. Apparatus as defined in claim 21, wherein flexible blade means and brush means are mounted on plurality of second bracket means located on an opposite side of said device, said second bracket means including second actuating means for selectively alternatively moving either of said flexible blade means or said brush means from a first inoperative position to a second operative position.

23. Apparatus as defined in claim 22 and including tie rod means connecting said first and second bracket means for moving flexible blade means into operative position on said one side of said device, and simultaneously, brush means into operative position on said opposite side of said device, and vice versa.

24. Apparatus for resurfacing a tennis court surface comprising:

frame means having a length at least equal to the width of a regulation tennis court;

a plurality of frame supporting wheels mounted on the underside of said frame means;

selectively engageable drive means mounted on said frame means for effecting movement of said frame means;

first flexible blade means and first brush means mounted on said frame means and extending substantially the length of said frame means, said first flexible blade means and first brush means mounted on a plurality of first bracket means located on one side of said device, said first bracket means including first actuating means for selectively alternatively moving either of said first flexible blade means or said first brush means from a first inoperative position to a second operative position.

25. Apparatus as defined in claim 24, wherein second flexible blade means and second brush means are mounted on a plurality of second bracket means located on an opposite side of said device, said second bracket means including second actuating means for selectively alternatively moving either of said second flexible blade means or said second brush means from a first inoperative position to a second operative position.

26. Apparatus as defined in claim 25 and including tie rod means connecting said first and second bracket means for moving said first flexible blade means into operative position on said one side of said device, and simultaneously said second brush means into operative position on said opposite side of said device, and vice versa.

* * * * *